US008914989B2

(12) United States Patent
Ghosh et al.

(10) Patent No.: US 8,914,989 B2
(45) Date of Patent: Dec. 23, 2014

(54) CLOTHES DRYER AND METHOD FOR ADJUSTING A DILUTION OF A TREATING SOLUTION BASED ON A DETECTED CLOTHES LOAD SIZE

(75) Inventors: Kaustav Ghosh, Benton Harbor, MI (US); Thomas A. Latack, Baroda, MI (US); Robert J. Pinkowski, Baroda, MI (US); Brian K. Rogers, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 803 days.

(21) Appl. No.: 13/170,717

(22) Filed: Jun. 28, 2011

(65) Prior Publication Data

US 2013/0000141 A1 Jan. 3, 2013

(51) Int. Cl.

| | |
|---|---|
| ***F26B 7/00*** | (2006.01) |
| ***D06F 58/28*** | (2006.01) |
| ***D06F 43/00*** | (2006.01) |
| ***D06F 43/02*** | (2006.01) |

(52) U.S. Cl.

CPC ..... *D06F 58/28* (2013.01); *D06F 43/005* (2013.01); *D06F 43/02* (2013.01); *D06F 2058/2861* (2013.01)

USPC ..... 34/389; 34/61; 34/380; 34/390; 34/524

(58) Field of Classification Search

CPC ..... D06F 58/203

USPC ..... 34/61, 380, 389, 390, 524

See application file for complete search history.

(56) References Cited

U.S. PATENT DOCUMENTS

| | | | | |
|---|---|---|---|---|
| 4,012,326 | A | 3/1977 | Rudy et al. | |
| 4,238,531 | A | 12/1980 | Rudy et al. | |
| 4,489,455 | A | 12/1984 | Spendel | |
| 6,463,766 | B2 | 10/2002 | Kubota et al. | |
| 6,491,840 | B1 | 12/2002 | Frankenbach et al. | |
| 6,584,633 | B2 * | 7/2003 | Chute et al. | 8/158 |
| 7,476,258 | B2 | 1/2009 | Birker et al. | |
| 7,997,006 | B2 * | 8/2011 | Son et al. | 34/381 |
| 2009/0282695 | A1 | 11/2009 | Kreutzfeldt et al. | |
| 2010/0000022 | A1 | 1/2010 | Hendrickson et al. | |
| 2010/0000024 | A1 | 1/2010 | Hendrickson et al. | |
| 2010/0000265 | A1 | 1/2010 | Hendrickson et al. | |
| 2010/0000573 | A1 | 1/2010 | Hendrickson et al. | |
| 2010/0287709 | A1 | 11/2010 | Doyle et al. | |

FOREIGN PATENT DOCUMENTS

| | | | |
|---|---|---|---|
| DE | 10302866 | A1 | 8/2004 |
| DE | 102009030330 | A1 | 1/2010 |
| DE | 102009030331 | A1 | 1/2010 |
| EP | 1852540 | B1 | 4/2009 |
| EP | 2055827 | A1 | 5/2009 |
| WO | 2010087662 | A2 | 8/2010 |

OTHER PUBLICATIONS

German Search Report for Counterpart DE102012103660, Jan. 11, 2013.

* cited by examiner

*Primary Examiner* — Kenneth Rinehart
*Assistant Examiner* — Gajanan M Prabhu

(57) ABSTRACT

A clothes dryer and method for forming and supplying a treating chemistry solution to a laundry load located in the treating chamber of the clothes dryer.

23 Claims, 3 Drawing Sheets

CLOTHES DRYER AND METHOD FOR ADJUSTING A DILUTION OF A TREATING SOLUTION BASED ON A DETECTED CLOTHES LOAD SIZE

BACKGROUND OF THE INVENTION

Dispensing clothes dryers may have a configuration based on a rotating drum that defines a treating chamber in which laundry items are placed for treating according to a cycle of operation and a dispensing system for dispensing a treating chemistry as part of the cycle of operation. A controller may be operably connected with the dispensing system and various components of the dryer to execute the cycle of operation. The cycle of operation may be selected manually by the user or automatically based on one or more conditions determined by the controller. Even when the proper amount of treating chemistry is dispensed, the dispensed treating chemistry may result in the build-up of residue on the interior surfaces defining the treating chamber which may transfer to the laundry when it is not desired to do so or provide a spot concentration of treating chemistry.

SUMMARY

A clothes dryer having a rotating treating chamber into which heated air may be provided to dry a wet laundry load within the treating chamber and a method of operating the clothes dryer including automatically determining a size of the laundry load within the treating chamber, automatically determining an amount of treating chemistry to be applied to the laundry load based on the determined size of the laundry load, automatically determining an application concentration at which the amount of treating chemistry is to be applied to the laundry load based on the determined size of the laundry load, forming a treating solution by mixing a concentrated form of the amount of treating chemistry with a diluent such that the treating solution has an application concentration of the treating chemistry, and supplying the treating solution to the treating chamber.

DESCRIPTION OF EMBODIMENTS OF THE INVENTION

Figure 1:
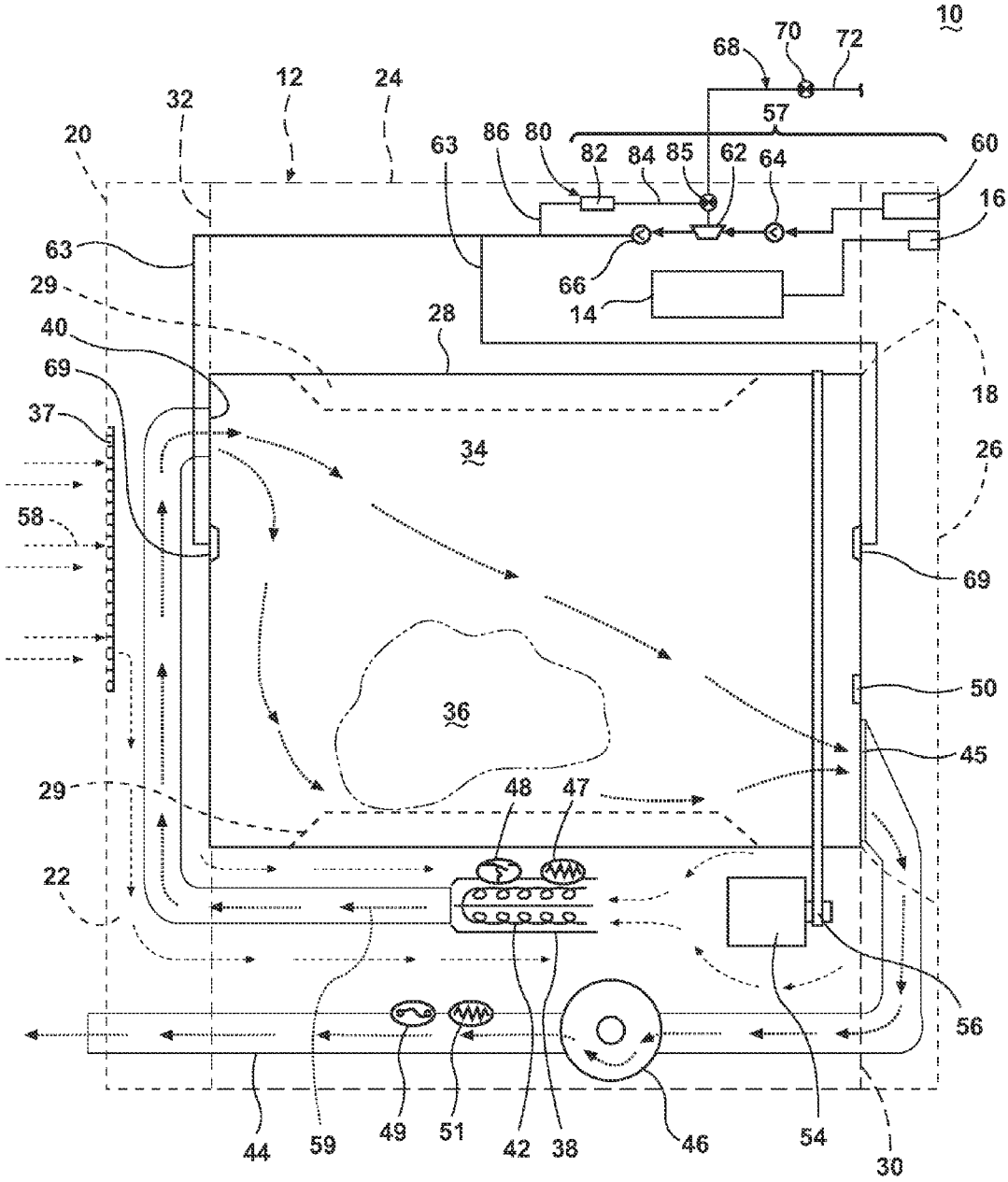
FIG. 1 is a schematic view of a clothes dryer according to a first embodiment of the invention.

FIG. 1 is a schematic view of a clothes dryer 10 that may be controlled according to one embodiment of the invention. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 in which may be provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary rear and front bulkheads 30, 32, which, along with the door 26, collectively define a treating chamber 34 for treating laundry. The treating chamber 34 is not fluidly coupled with a drain. Therefore, excess treating chemistry or a buildup of residual treating chemistry may not be simply rinsed and/or washed away, such as would be possible in a clothes washer.

Non-limiting examples of laundry that may be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be treated in the clothes dryer 10.

The drum 28 may include at least one lifter 29. In most dryers, there may be multiple lifters 29. The lifters 29 may be located along an inner surface of the drum 28 defining an interior circumference of the drum 28. The lifters 29 may facilitate movement of a laundry load 36 within the drum 28 as the drum 28 rotates.

The drum 28 may be operably coupled with a motor 54 to selectively rotate the drum 28 during a cycle of operation. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled with a hub of the drum 28.

An air system may be provided to the clothes dryer 10. The air system supplies air to the treating chamber 34 and exhausts air from the treating chamber 34. The supplied air may be heated or not. The air system may have an air supply portion that may form, in part, a supply conduit 38, which has one end open to ambient air via a rear vent 37 and another end fluidly coupled with an inlet grill 40, which may be in fluid communication with the treating chamber 34. A heating system for heating the supplied air may include a heating element 42, which may lie within the supply conduit 38 and may be operably coupled with and controlled by the controller 14. If the heating element 42 is turned on, the supplied air will be heated prior to entering the drum 28.

The air system may further include an air exhaust portion that may be formed in part by an exhaust conduit 44. A lint trap 45 may be provided as the inlet from the treating chamber 34 to the exhaust conduit 44. A blower 46 may be fluidly coupled with the exhaust conduit 44. The blower 46 may be operably coupled with and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct (not shown) for exhausting the air from the treating chamber 34 to outside the clothes dryer 10.

The air system may further include various sensors and other components, such as a thermistor 47 and a thermostat 48, which may be coupled with the supply conduit 38 in which the heating element 42 may be positioned. The thermistor 47 and the thermostat 48 may be operably coupled with each other. Alternatively, the thermistor 47 may be coupled with the supply conduit 38 at or near to the inlet grill 40. Regardless of its location, the thermistor 47 may be used to aid in determining an inlet temperature. A thermistor 51 and a thermal fuse 49 may be coupled with the exhaust conduit 44, with the thermistor 51 being used to determine an outlet air temperature.

A moisture sensor 50 may be positioned in the interior of the treating chamber 34 to monitor the amount of moisture of the laundry in the treating chamber 34. One example of a moisture sensor 50 may be a conductivity strip. The moisture sensor 50 may be operably coupled with the controller 14 such that the controller 14 receives output from the moisture sensor 50. The moisture sensor 50 may be mounted at any location in the interior of the dispensing dryer 10 such that the moisture sensor 50 may be able to accurately sense the moisture content of the laundry. For example, the moisture sensor 50 may be coupled with one of the bulkheads 30, 32 of the drying chamber 34 by any suitable means.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled with a water supply 68. The dispensing system 57 may be further coupled with the treating chamber 34 through one or more nozzles 69. As illustrated, nozzles 69 may be provided at the front and rear of the treating chamber 34 to provide the treating chemistry or liquid to the interior of the treating chamber 34, although other configurations are also possible. The number, type and placement of the nozzles 69 are not germane to the invention.

As illustrated, the dispensing system 57 may include a reservoir 60, which may be a cartridge, for a treating chemistry that may be releasably coupled with the dispensing system 57, which dispenses the treating chemistry from the reservoir 60 to the treating chamber 34. The reservoir 60 may include one or more cartridges configured to store one or more treating chemistries in the interior of cartridges. A suitable cartridge system may be found in U.S. Pub. No. 2010/0000022 to Hendrickson et al., filed Jul. 1, 2008, entitled "Household Cleaning Appliance with a Dispensing System Operable between a Single Use Dispensing System and a Bulk Dispensing System," which is herein incorporated by reference in its entirety. The treating chemistry may be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation. The water supply 68 may be fluidly coupled with the mixing chamber 62 to provide water from the water source to the mixing chamber 62. The water supply 68 may include an inlet valve 70 and a water supply conduit 72. It is noted that, instead of water, a different liquid such as another treating chemistry, diluent, or solvent may be provided from the exterior of the clothes dryer 10 to the mixing chamber 62. When a liquid is introduced into the mixing chamber 62 along with treating chemistry from the reservoir 60 a treating solution may be formed and may be dispensed to the treating chamber 34 through the supply conduit 63.

The dryer 10 may also be provided with a steam generating system 80 which may be separate from the dispensing system 57 or integrated with portions of the dispensing system 57 for dispensing steam and/or liquid to the treating chamber 34 according to a cycle of operation. The steam generating system 80 may include a steam generator 82 fluidly coupled with the water supply 68 through a steam inlet conduit 84. A fluid control valve 85 may be used to control the flow of water from the water supply conduit 72 between the steam generating system 80 and the dispensing system 57. The steam generator 82 may further by fluidly coupled with the one or more supply conduits 63 through a steam supply conduit 86 to deliver steam to the treating chamber 34 through the nozzles 69. Alternatively, the steam generator 82 may be coupled with the treating chamber 34 through one or more conduits and nozzles independently of the dispensing system 57.

The steam generator 82 may be any type of device that converts the supplied liquid to steam. For example, the steam generator 82 may be a tank-type steam generator that stores a volume of liquid and heats the volume of liquid to convert the liquid to steam. Alternatively, the steam generator 82 may be an in-line steam generator that converts the liquid to steam as the liquid flow through the steam generator 82.

It will be understood that the details of the dispensing system 57 and steam generating system 80 are not germane to the embodiments of the invention and that any suitable dispensing system and/or steam generating system may be used with the dryer 10. It is also within the scope of the invention for the dryer 10 to not include a steam generating system.

Figure 2:
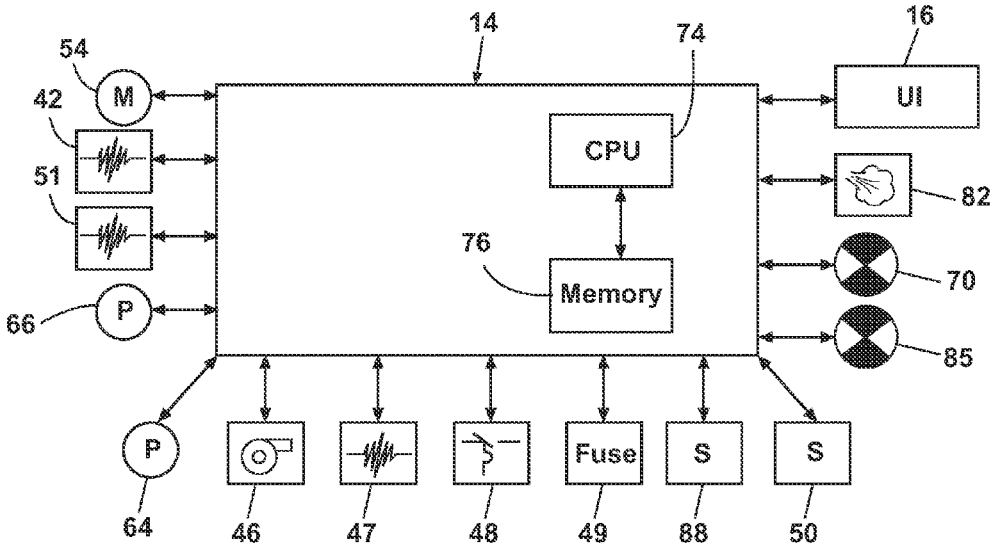
FIG. 2 is a schematic view of a controller of the clothes dryer in FIG. 1.

FIG. 2 is a schematic view of the controller 14 coupled with the various components of the dryer 10. The controller 14 may be communicably coupled with components of the clothes dryer 10 such as the heating element 42, blower 46, thermistor 47, thermostat 48, thermal fuse 49, thermistor 51, moisture sensor 50, motor 54, inlet valve 70, pumps 64, 66, steam generator 82, and fluid control valve 85 to either control these components and/or receive their input for use in controlling the components. The controller 14 may also be operably coupled with a load size sensing system having one or more sensors 88, which may be communicably coupled with the controller 14 to provide an output indicative of the load size. Non-limiting examples of such sensors 88, which may be used to provide an output indicative of load size include: a weight sensor, a motor torque sensor, and an infrared sensor. It will be understood that the details of the load size sensing system and its sensors are not germane to the embodiments of the invention and that any suitable load size sensing system may be used with the dryer 10.

The controller 14 may also be operably coupled with the user interface 16 to receive input from the user through the user interface 16 for the implementation of the drying cycle and provide the user with information regarding the drying cycle. The user interface 16 may have operational controls such as dials, lights, knobs, levers, buttons, switches, and displays enabling the user to input commands to the controller 14 and receive information about a cycle of operation from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may include a central processing unit (CPU) 74 and an associated memory 76 where various cycles of operation and associated data, such as look-up tables, may be stored. One or more software applications, such as an arrangement of executable commands/instructions may be stored in the memory 76 and executed by the CPU 74 to implement the one or more cycles of operation.

In general, the controller 14 may implement a cycle of operation to effect a treating of the laundry in the treating chamber 34, which may or may not include drying. The controller 14 may actuate the blower 46 to draw an inlet air flow 58 (FIG. 1) into the supply conduit 38 through the rear vent 37 when air flow is needed for a selected treating cycle. The controller 14 may activate the heating element 42 to heat the inlet air flow 58 as it passes over the heating element 42, with the heated air 59 being supplied to the treating chamber 34. The heated air 59 may be in contact with a laundry load 36 as it passes through the treating chamber 34 on its way to the exhaust conduit 44 to effect a moisture removal of the laundry. The moisture removed from the laundry and the heated air may exit the treating chamber 34, and flow through blower 46 and the exhaust conduit 44 to the outside of the clothes dryer 10. The thermistor 51 may sense the temperature of the air that passes through the exhaust conduit 44 and send to the controller 14 a signal indicative of the sensed temperature. The controller 14 continues the cycle of operation until completed. If the cycle of operation includes drying, the controller 14 determines when the laundry may be dry. The determination of a "dry" load may be made in different ways, but may often be based on the moisture content of the laundry, which is typically set by the user based on the selected cycle, an option to the selected cycle, or a user-defined preference.

During a cycle of operation, one or more treating chemistries may be provided to the treating chamber 34 by the dispensing system 57 as actuated by the controller 14. To dispense the treating chemistry, the metering pump 64 is actuated by the controller 14 to pump a predetermined quantity of the treating chemistry stored in the cartridge 60 to the mixing chamber 62, which may be provided as a single charge, multiple charges, or at a predetermined rate, for example. The treating chemistry may be in the form of a gas, liquid, solid, gel or any combination thereof, and may have any chemical composition enabling refreshment, disinfection, whitening, brightening, increased softness, reduced odor, reduced wrinkling, stain repellency or any other desired treatment of the laundry. The treating chemistry may be composed of a single chemical or a mixture of chemicals.

The addition of treating chemistry to the treating chamber 34 to treat a load of laundry according to a cycle of operation may result in treating chemistry that may not be absorbed by the laundry and leaves a residue on the interior surfaces defining the treating chamber 34, such as the door 26, the drum 28 and the rear and front bulkheads 30, 32. Further, the heated air supplied to the dryer 10 evaporates any liquid that is built-up in the treating chamber, especially since it is not possible to rinse/drain the liquid. The evaporation of the treating chemistry further increases the likelihood that a residue may remain and may increase the concentration of the residue as evaporation continues. The build-up of such residue may result in staining or discoloration on the interior surfaces defining the treating chamber 34, which may be visually unappealing to a user. Further, such residue may also redeposit on laundry, which is normally wet when placed in the treating chamber, leading to a flawed appearance of the laundry, such as a concentration of a brightener that would leave visibly noticeable areas of differing brightness, as well as a permanent discoloration or structural change to the fabric. These problems may be compounded when the load size is smaller because a smaller load takes up a smaller portion of the treating chamber 34 and only a part of the treating chemistry that is supplied goes directly onto the clothes load and the rest is oversprayed onto the interior of the treating chamber 34.

The previously described clothes dryer 10 provides the structure necessary for the implementation of the method of the invention, which addresses the problem of treating chemistry buildup and re-deposition. Embodiments of the method will now be described in terms of the operation of the clothes dryer 10. The embodiments of the method function to reduce the amount of treating chemistry residue which may build-up on the interior surfaces of the treating chamber 34 due to overspray.

Figure 3:
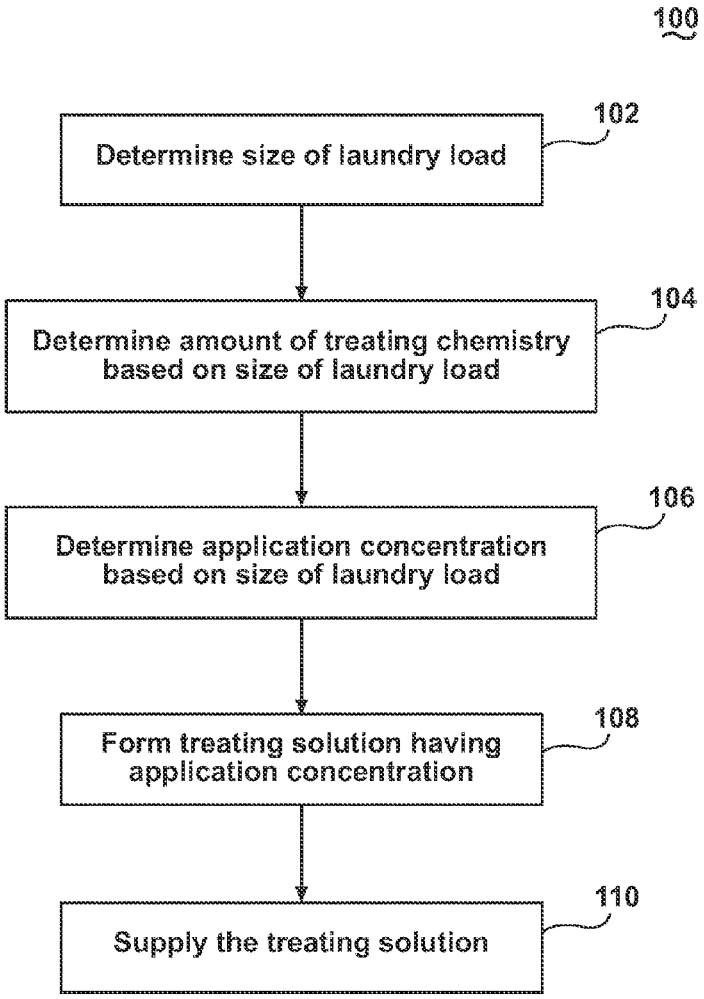
FIG. 3 is a flow chart illustrating a method of forming and supplying a treating solution according to a second embodiment of the invention.

FIG. 3 is a flow-chart depicting a method 100 of dispensing a treating chemistry solution according to one embodiment of the invention. The method 100 may be carried out by the controller 14 using information inputted by the user via the user interface 16 and from the sensors 50, 47, 51, and 88. The method 100 described herein may be applicable to a chemistry-enhanced drying cycle. The sequence of steps depicted is for illustrative purposes only and is not meant to limit the method 100 in any way as it is understood that the steps may proceed in a different logical order, additional or intervening steps may be included, or described steps may be divided into multiple steps, without detracting from the invention.

Generally, in normal operation of the dryer 10, a user first selects an appropriate cycle of operation via the user interface 16. Non-limiting examples of cycles of operation include a normal drying cycle, a refreshing cycle, and a chemistry-enhanced drying cycle. A normal drying cycle generally includes drying the load without the application of a treating chemistry. A refreshing cycle generally includes applying a treating chemistry to a dry or relatively dry load and thereafter drying the load. A chemistry-enhanced drying cycle generally includes applying a treating chemistry to wet load and drying the load. It is also contemplated that a user may select the level of treating chemistry dispensed during such cycles. Examples of treating chemistry levels include none, extra-low, low, medium, high, and extra-high. The user may also optionally select other cycle modifiers, such as a load color, and/or a fabric type. Examples of load colors are whites and colors. Examples of fabric types are cotton, silk, polyester, delicates, permanent press, and heavy duty.

The user-selections may occur prior to the start of the method 100. If a user selects a cycle of operation that does not use treating chemistry, the method 100 may not be performed for that single cycle of operation. However, if the user selects a cycle of operation that does not exclude the use of a treating chemistry then the controller 14 may execute the method 100.

The method 100 assumes that a user has provided the appropriate treating chemistry, in the reservoir 60, placed a wet laundry load 36 within the treating chamber 34, and selected a cycle of operation that includes dispensing the treating chemistry. A load may be considered wet if the moisture content is greater than 30%. The method 100 may be initiated automatically when the user closes the door 26, or at the start of the user-selected cycle of operation.

The method 100 begins at 102 where the clothes dryer 10 automatically determines a size of the laundry load 36 within the treating chamber 34. Such a load size determination may be known by means such as a weight sensor, a motor torque measurement, or a load mass estimation (LME) technique that uses a supply air temperature sensor and an exhaust air temperature sensor near the beginning of the drying cycle, such as during the first two minutes of the drying cycle. Such LME techniques may determine the load size by comparing the slopes of the supply and exhaust air temperatures. Further, an infrared sensor may be used as described in U.S. application Ser. No. 12/641,519, filed Dec. 18, 2009, entitled "Method For Determining Load Size in a Clothes Dryer Using an Infrared Sensor," which is herein incorporated by reference in its entirety.

From the output of the load size sensor 88 the controller 14 at 102 may determine a quantitative load size, a qualitative load size, or both a quantitative and qualitative load size of the laundry load 36. Determining a qualitative size of the laundry load 36 may include determining a size from a predetermined subset of sizes such as whether the load size may be small, medium, or large. It may also be understood that other qualitative load sizes may be used, including, but not limited to, extra-small, small, medium, large and extra-large loads. Determining a quantitative load size may include but is not limited to a size based on weight, number of articles, or any combination thereof. For example, determining a quantitative size of the laundry load 36 may include determining a value indicative of the weight of the laundry load 36. Such a value may be a value indicative of the mass of the laundry load 36.

It has been contemplated that determining the qualitative size of the laundry load 36 may be based on the determined quantitative size. For example, at 102 the controller 14 may determine that the mass of the laundry load 36 is 5.5 kg and may determine from the mass that the qualitative size of the laundry load 36 is large. Alternatively, an estimated weight of the load may be determined based on a qualitative size of the load. For example, the controller 14 at 102 may determine that the laundry load 36 in the treating chamber 34 is a medium size load and may approximate its weight at 3.5 kg. For illustrative purposes only, a small load may correlate to laundry weighing 2 kg or less, a medium load may range from 2-5 kg, and a large load may be over 5 kg.

At 104 the controller 14 may automatically determine an amount of treating chemistry to be applied to the laundry load 36 based on the determined size of the laundry load 36. The amount of treating chemistry may be determined regardless of whether the size determined at 102 is quantitative or qualitative. The controller 14 may, for example, determine the amount of treating chemistry as a function of a percent of the determined size of the load. In such an instance, the determined size of the load would include the weight of the load and the percent of the determined size would include a percent of the weight of the load. The function of a percent of the determined size of the load may be constant for a given treating chemistry and may be determined experimentally and stored in the memory 76 of the controller 14. A non-limiting example may be a default of 0.5% treating chemistry to fabric by weight. Such a default percentage may allow the concentrated treating chemistry stored in the cartridge 60 to last a predetermined number of cycles so that the user does not have to frequently change the cartridge.

Alternatively, the controller 14 may access a look-up table of amounts of treating chemistry stored in the memory 76 and use the determined laundry load size to look-up the amount of treating chemistry to be applied. For example, for a medium size load, of approximately 3.5 kg weight the amount of treating chemistry to be supplied, without taking other parameters into consideration, may be 17.5 g of a particular treating chemistry. As a further example for a large size load, of approximately 5 kg weight the amount of treating chemistry to be supplied, without taking other parameters into consideration, may be 25 g of treating chemistry for the particular treating chemistry.

It has also been contemplated that along with the size of the load the amount of treating chemistry may further be determined based on parameters such as user selections of treating chemistry levels or degree of treating desired by the user, or the type of fabrics in the load. These parameters may be supplied by the user as part of the cycle selection as previously described. In such instances the function of a percent of treating chemistry to fabric by weight as determined by the controller 14 may be any level and such levels may be user selected. A non-limiting example may be treating chemistry to fabric by weight levels of 0, 0.3%, 0.4%, 0.5%, 0.6%, and 0.7% for selected treating chemistry levels of none, extra-low, low, medium, high and extra-high, respectively. Alternatively, the controller 14 may access a look-up table of amounts of treating chemistry to be supplied that are stored in the memory 76 and use the determined laundry load size and a dispense level selection to look-up the amount of treating chemistry to be supplied. For example, for a medium size load, of approximately 3.5 kg weight, and extra-low treating chemistry level, of 0.30% treating chemistry to fabric by weight, the determined amount of treating chemistry may be 10.5 g. As a further example for a large size load, of approximately 5 kg weight, and a high treating chemistry level of 0.7% treating chemistry to fabric by weight, the determined amount of treating chemistry may be 35 g. Alternatively, one or more formulas may be used by the controller to determine the amount of treating chemistry to be applied to the load based on the determined size of the load.

Next, the controller 14 may determine at 106 an application concentration at which the amount of treating chemistry determined at 104 is to be applied to the laundry load 36 based on the determined size of the laundry load 36. The determination of the application concentration may take into account at least one of two concerns: the first being that increased application concentrations may lead to increased concentrations in the residue on the interior surfaces defining the treating chamber 34, as described above, and the second being that decreasing the application concentration through dilution may lead to unacceptable cycle times because more liquid will be applied as part of the treating process, and the liquid will need to be dried as part of the drying process. Thus, the diluteness of the determined application concentration may be limited because of increased dry times. Treating with a higher application concentration reduces the amount of additional liquid required to dilute a given amount of treating chemistry determined at 104. Such reduced liquid means shorter drying times and less energy consumption. By way of non-limiting example, the diluteness of the application concentration may be limited so that it does not create more than a 10% increase in dry time and/or energy consumption.

Preferably the application concentration may be dilute enough that it does not provide a flawed appearance of the laundry as well as a permanent discoloration or structural change to the fabric and does not unacceptably increase the dry time. Appropriate application concentrations may vary by treating chemistry and may be determined experimentally and stored in the memory 76 of the controller 14. By way of non-limiting example, the determination at 106 may be conducted by the controller 14 looking up an application concentration of the treating chemistry from a look-up table stored in the memory 76 based on the load size. It is contemplated that the application concentration may increase as a function of the determined load size. The application may increase with larger load sizes because as the load size increases the load takes up a larger volume of the treating chamber 34 resulting in less potential for overspray on to the interior portions of the treating chamber 34. A non-limiting example may include application concentrations of 2.6% for a small size load, 4.5% for a medium size load and 6.6% for a large size load.

Once the application concentration is determined at 106, a treating solution may be formed at 108 from a concentrated form of the amount of treating chemistry and a diluent such that the treating solution has an application concentration of the treating chemistry. The concentrated form treating chemistry may be any known type of treating chemistry, including chromophore chemistry, a stain-repellency chemistry, anti-wrinkle agents, softeners, perfumes, or combinations thereof stored in the reservoir 60. To form the treating solution the determined amount of treating chemistry determined at 104 may be supplied to the mixing chamber 62. The introduction of the treating chemistry to the mixing chamber 62 may be accomplished by the controller 14 appropriately controlling the chemistry metering pump 64. The controller 14 at the same time may also introduce a diluent liquid to the mixing chamber 62. The diluent may be water, which may be supplied through the supply inlet valve 70 to produce a treating solution at the required application concentration within the mixing chamber 62. For example, if an application concentration of 3% may be desired and the reservoir 60 contains an 8% concentrated form of treating chemistry, then the water supply inlet valve 70 and the treating chemistry metering pump 64 may be controlled by the controller 14 to allow a flow rate of water and concentrated treating chemistry contained in the reservoir 60 to achieve a 3% application concentration of the treating chemistry in the mixing chamber 62. The chemistry metering pump 64 and water supply inlet valve 70 may be selectively controlled to permit their setting to achieve a continuous flow of each to the mixing chamber 62. Alternatively, the chemistry metering pump 64 and water supply inlet valve 70 may only have off and on controls, without variable settings. The exact means of controlling the chemistry metering pump 64 and the water supply inlet valve 70 to form the treating solution at the determined application concentration are not germane to the invention.

Then at 110 the treating solution having the application concentration of the treating chemistry may be introduced to the laundry in the treating chamber 34. More specifically, the delivery pump 66 may be operated to supply the treating solution from the mixing chamber 62 to the treating chamber 34 through the supply conduit 63. The treating solution may be supplied by the dispensing system 57 to the laundry load 36 in the treating chamber 34 through one or more nozzles 69, which may introduce the treating solution as a spray, stream, mist, aerosol or droplets.

During the treating solution supply step at 110, the drum 28 may be rotated to tumble the clothes in the treating chamber 34 to promote a more uniform distribution of the treating solution. Further, the rotation of the treating chamber 34 may be intermittent including at least one rotating phase and one non-rotating phase. During such intermittent rotation it is contemplated that the supplying of the treating solution may occur during at least the non-rotating phase. Additionally, heated or unheated air may be introduced into the treating chamber 34 during tumbling to provide additional turbulence for the purpose of a more even distribution of treating chemistry on to the laundry. It is contemplated that the method 100 may be repeated for each treating chemistry applied to the laundry during the cycle of operation.

The above method assumed that the user provided wet laundry in the treating chamber. Dry loads tend to have highly disparate affinities to water depending on attributes of the fabrics in the laundry load 36 and wetting the laundry may reduce the level of disparity in the affinity to water for various types of fabric in the laundry load 36. It is contemplated that the moisture content of the laundry may be determined before the method 100 begins or as a portion of the method 100. Therefore, when the load may be considered dry, water may be added to the laundry load 36 to a pre-determined level that promotes uniform distribution of the treating chemistry. The predetermined level may, for example, be 10% moisture. The moisture may be added by the controller 14 by affecting a flow of water from the water supply line 68 by opening the water supply inlet valve 70 until the predetermined level of moisture is dispensed on to the laundry. Optionally, after the desired moisture content is reached, the drum 28 may be rotated to tumble the load to ensure uniform wetting of the laundry prior to introducing the treating solution at 110.

Highly concentrated overspray may collect on the interior of the treating chamber and damage laundry. The embodiment described above determines and applies a treating solution having an appropriate application concentration based on the load size. More specifically, the embodiments act to lessen residue of treating chemistry that may accumulate on the interior surfaces defining the treating chamber 34 which in turn lessens the undesirable transfer to the laundry in the treating chamber 34 during use. Further, the above described embodiments allow a minimum amount of added moisture when forming a treating solution. This is desirable as additional moisture increases dry times resulting in user dissatisfaction. The above embodiments dilute the highly concentrated treating chemistry enough where damage to the laundry may be prevented but controls the dilution so as not to overly increase the dry time of the clothing. More specifically, with large wet loads a very high concentrated treating solution may be dispensed or sprayed onto the load because little is oversprayed as the larger load takes up a larger portion of the treating chamber 34. This adds relatively little additional moisture to the load being dried. Thus, the above embodiments act to apply an amount of treating chemistry at an application concentration, which may prevent damage to the laundry and will not substantially increase dry times.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method of operating a clothes dryer having a rotating treating chamber into which heated air may be provided to dry a wet laundry load within the treating chamber, the method comprising:

automatically determining a size of the laundry load within the treating chamber;

automatically determining an amount of treating chemistry to be applied to the laundry load based on the determined size of the laundry load;

automatically determining an application concentration at which the amount of treating chemistry is to be applied to the laundry load based on the determined size of the laundry load;

forming a treating solution by mixing a concentrated form of the amount of treating chemistry with a diluent such that the treating solution has an application concentration of the treating chemistry; and supplying the treating solution to the treating chamber, wherein the automatically determining the size of the laundry load comprises automatically determining a qualitative size of the laundry load, and wherein the qualitative size is based on a quantitative size of the laundry load.

2. The method of claim 1 wherein the treating chamber is rotated during the supplying of the treating solution.

3. The method of claim 2 wherein the rotation is intermittent comprising at least one rotating phase and one non-rotating phase.

4. The method of claim 3 wherein the supplying of the treating solution occurs during at least the non-rotating phase.

5. The method of claim 1 wherein the automatically determining the qualitative size of the laundry load comprises determining a size from a predetermined subset of sizes.

6. The method of claim 5 wherein the predetermined subset of sizes comprises at least: small, medium, and large.

7. The method of claim 5 wherein the automatically determining a quantitative size of the laundry load comprises determining a value indicative of the weight of the laundry load.

8. The method of claim 7 wherein the value indicative of the weight of the laundry load is a value indicative of the mass of the laundry load.

9. The method of claim 1 wherein the automatically determining the amount of treating chemistry based on the size of the laundry load comprises automatically determining the amount of treating chemistry as a function of a percent of the determined size of the load.

10. The method of claim 9 wherein the determined size of the load comprises the weight of the load and the percent of the determined size comprises a percent of the weight of the load.

11. The method of claim 10 wherein the weight of the load is estimated based on the qualitative size of the load.

12. The method of claim 9 wherein the percent of the determined size of the load is constant for a given treating chemistry.

13. The method of claim 12 wherein the application concentration increases as a function of the determined load size.

14. The method of claim 1 wherein the supplying the treating solution to the treating chamber comprises spraying the treating solution into the treating chamber.

15. The method of claim 1, further comprising automatically determining an amount of another treating chemistry to be applied to the laundry load based on the determined size of the laundry load and automatically determining an application concentration at which the amount of the another treating chemistry is to be applied to the laundry load based on the determined size of the laundry load.

16. The method of claim 15, further comprising forming another treating solution by mixing a concentrated form of the amount of the another treating chemistry with a diluent such that the another treating solution has the determined application concentration and supplying the another treating solution to the treating chamber.

17. The method of claim 1, further comprising supplying steam during at least one of before, during, or after supplying the treating solution to the treating chamber.

18. A clothes dryer configured to treat a load of laundry according to a cycle of operation, comprising: a rotatable treating chamber configured to receive the load of laundry; an air system for supplying air to the treating chamber; a heating system for heating the supplied air; a dispensing system configured to form a treating solution from a mixture of treating chemistry and diluent and dispense the treating solution to the treating chamber; a load size sensing system configured to sense a size of the load located in the treating chamber and provide an output indicative thereof; and a controller operably coupled with the load size sensing system to receive the output, and configured to determine a qualitative size of the laundry load based on the output, to control the operation of the dispensing system, to determine an amount of treating chemistry to be dispensed based on the qualitative size, and to control a concentration of the treating chemistry in the treating solution based on the qualitative size.

19. The clothes dryer of claim 18 wherein the dispensing system comprises a water supply operably coupled with and controlled by the controller to supply water to the dispensing system as the diluent.

20. The clothes dryer of claim 18 wherein the controller is further configured to determine a weight of the laundry load based on the output.

21. The clothes dryer of claim 20 wherein the controller is configured to determine the amount of treating chemistry to be dispensed as a function of a percent of the determined weight of the load.

22. The clothes dryer of claim 21 wherein the controller is configured to increase the concentration of the treating chemistry in the treating solution as the load size increases.

23. The clothes dryer according to claim 18 wherein the controller is further configured to rotate the treating chamber during at least one of while the treating solution is being applied and after the treating solution is applied.

* * * * *